United States Patent [19]

Sessions, Jr.

[11] 4,330,146

[45] May 18, 1982

[54] PORTABLE DOOR LOCK

[76] Inventor: E. Reed Sessions, Jr., P.O. Box 7778, Macon, Ga. 31204

[21] Appl. No.: 109,093

[22] Filed: Jan. 2, 1980

[51] Int. Cl.[3] ..... E05C 19/18

[52] U.S. Cl. ..... 292/258

[58] Field of Search ..... 292/258, 288, 298, 297, 292/290, 292, DIG. 15

[56] References Cited

U.S. PATENT DOCUMENTS

| | | | |
|---|---|---|---|
| 794,400 | 7/1905 | Farrell | 292/292 |
| 1,579,298 | 4/1926 | Fry et al. | 292/298 |
| 3,181,319 | 5/1965 | Hudon | 292/292 X |
| 3,930,678 | 1/1976 | Alexander | 292/288 |
| 4,198,088 | 4/1980 | Tochihara | 292/288 |

FOREIGN PATENT DOCUMENTS

| | | | |
|---|---|---|---|
| 148717 | 8/1920 | United Kingdom | 292/292 |

*Primary Examiner*—Richard E. Moore

[57] ABSTRACT

The purpose of the door lock is to secure a door from both sides temporarily (while building is vacated) with as little damage to door and frame as possible. When the apartment is again occupied, door lock can be used on another residence (apartment). Most rental property has locks on exterior doors that can be operated from the inside without a key. This type of lock is used so that occupants won't have to locate a key in the event of a fire. When the residence is vacated, and the appliances are left, all one needs to do is break a window, enter, open a door, and carry out appliances. The door lock will prevent such burglary by making it virtually impossible to open the door.

2 Claims, 1 Drawing Figure

ISOMETRIC VIEW (ASSEMBLED)

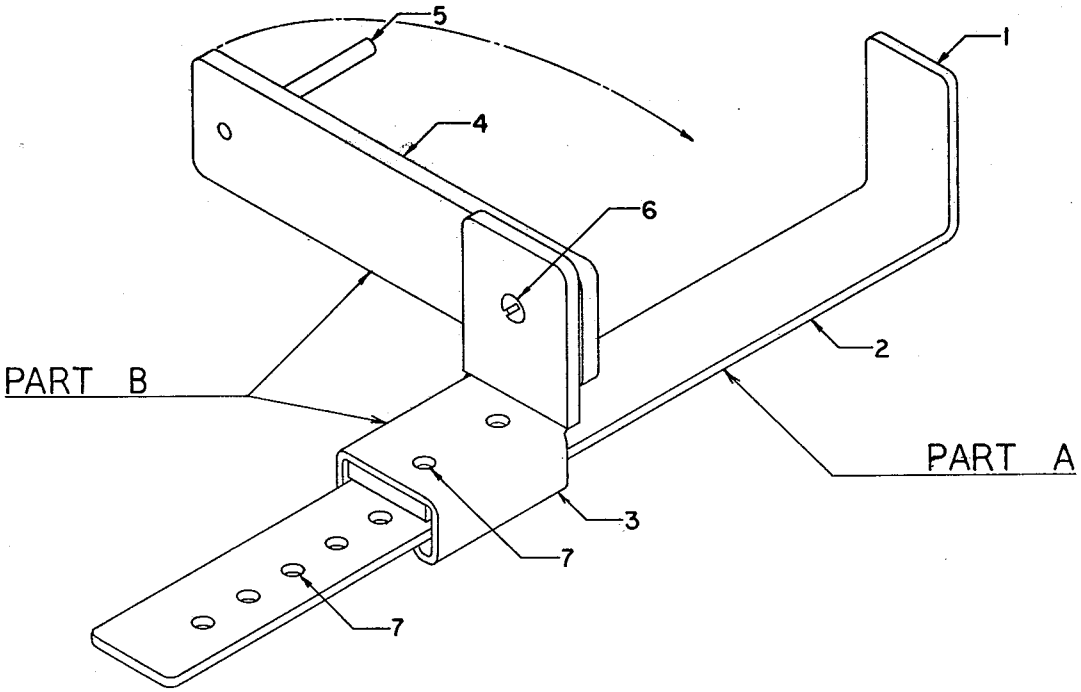
ISOMETRIC VIEW
(ASSEMBLED)

PORTABLE DOOR LOCK

The item to be patented is a completely new way of locking a door. It is to be called a portable door lock.

The FIGURE in the drawing shows an assembled view of the portable door lock.

The portable door lock is comprised of Part A having a bar portion 2 having a series of holes 7 at one end, and, at the other end, a portion 1 angled to form an L shape with 2. Part B is comprised of a bracket 3, which has holes 7 which match those in bar portion 2, and an arm 4 pivoted at 6 to the bracket 3. This arm has a pin 5 extending toward portion 1. The parts which form the door lock are of steel. In use, a hole is drilled in the outside door facing or wall adjacent to the latch edge of the door. Portion 1 is placed against the inside of the door, with portion 2 under and extending beyond the outside of the door. The bracket 3 is slid onto portion 2 against the door, with the arm 4 positioned so that pin 5 enters the hole drilled in the door facing or wall. A padlock is placed through the bracket 3 and a selected hole 7 in portion 2. The door cannot then be opened until the lock is removed. The lock can be used on left or right hand doors by swinging the arm 4 to the desired left or right hand position (see arrow in the FIGURE). Measurements of the parts may be varied. The door lock is portable from one building to another; it secures the building with minimum esthetic damage, and it obviates the need of permanent, thus expensive, new locks.

I claim:

1. A portable door lock comprised of an L-shaped bar which goes under and inside a door on the latch side and has a bracket which slides onto it for movement to the thickness of the door jam, means to receive the padlock to lock said bracket in position on said bar, and an arm pivoted on said bracket having a part extending therefrom so that when the bracket is moved the part on the pivoting arm can be inserted into a small hole in the door jam facing or adjacent wall, and a padlock can be affixed to the bracket and bar so that it is rigidly secured inside and out regardless of which side of the door the hinge is on.

2. A portable door lock, according to claim 1, characterized by the pivoting arm being so shaped and constructed that the device may be used on left or right hand doors and the part on the pivoting arm is a steel pin which holds the device rigidly in place.

* * * * *